US010093397B2

(12) United States Patent
Martino

(10) Patent No.: US 10,093,397 B2
(45) Date of Patent: Oct. 9, 2018

(54) ENHANCED BODY BOARD

(71) Applicant: Marc Gregory Martino, Westlake Village, CA (US)

(72) Inventor: Marc Gregory Martino, Westlake Village, CA (US)

( * ) Notice: Subject to any disclaimer, the term of this patent is extended or adjusted under 35 U.S.C. 154(b) by 0 days.

(21) Appl. No.: 15/271,080

(22) Filed: Sep. 20, 2016

(65) Prior Publication Data

US 2017/0080996 A1 Mar. 23, 2017

Related U.S. Application Data

(60) Provisional application No. 62/221,577, filed on Sep. 21, 2015.

(51) Int. Cl.
*B63B 35/79* (2006.01)

(52) U.S. Cl.
CPC .. *B63B 35/7906* (2013.01); *B63B 2035/7903* (2013.01)

(58) Field of Classification Search
CPC ..... B63B 21/56; B63B 35/73; B63B 35/74; B63B 35/79; B63B 35/85; B63B 35/7906; B63B 35/81; B63C 9/00; B63C 9/08
USPC ..... 441/55, 74, 65
See application file for complete search history.

(56) References Cited

U.S. PATENT DOCUMENTS 1,843,617 A * 2/1932 Marshall ..... B63C 9/08 441/55
3,543,712 A * 12/1970 Vasilatos ..... A63B 35/12 441/55
3,716,013 A * 2/1973 Vasilatos ..... B63B 35/74 441/55
5,106,331 A * 4/1992 Lizarazu ..... B63B 35/7906 441/55
5,738,555 A * 4/1998 Saghri ..... B63B 35/7906 441/65

* cited by examiner

*Primary Examiner* — Lars A Olson
(74) *Attorney, Agent, or Firm* — Hackler Daghighian Martino & Novak

(57) ABSTRACT

A body board for use by a rider in water includes a buoyant board body defined as having a top rider surface opposite a bottom submerged surface, a front half opposite a rear half, a left half opposite a right half and a board centerline. The board centerline extends from the front section half to the rear section half separating the left half from the right half. A left side riser is disposed on the top rider surface located in the left half and rear half, the left side riser extending above the top rider surface and configured to abut a rider's left rib cage and/or left hip. A right side riser is disposed on the top rider surface located in the right half and rear half, the right side riser extending above the top rider surface and configured to abut a rider's right rib cage and/or right hip.

23 Claims, 6 Drawing Sheets

ENHANCED BODY BOARD

CROSS-REFERENCE TO RELATED APPLICATIONS

This application claims priority to provisional application 62/221,577 filed on Sep. 21, 2015, the entire contents of which are fully incorporated herein with this reference.

FIELD OF THE INVENTION

The present invention generally relates to body boards for use in the water, such as the ocean. More particularly, the present invention relates to a body board with side risers that better grip and hold a rider onto the board such that one's hands are freed for swimming.

BACKGROUND OF THE INVENTION

Body boarding is a popular sport and activity along shores where waves are constantly breaking. Typically a person (rider) will take a floatation board (body board) into the water for riding it along the breaking waves. The person lays upon the board to enhance their buoyancy thereby facilitating the ability to ride the wave.

However, these boards are hard to control. Typically a person must hold onto the board with one or two hands to prevent it from slipping away. This prevents the person from paddling with their hands. Catching a wave usually requires a person to use their hands but yet they cannot let go of the board at the same time. Accordingly, catching a wave for novices is extremely difficult.

What is needed is a board that is designed to cradle the human body such that it is not necessary to hold onto the board while swimming and using one's hands. The present invention fulfills these needs and provides other related advantages.

SUMMARY OF THE INVENTION

An exemplary embodiment of a body board for use by a rider in water the rider laying upon the body board comprises: a buoyant board body defined as comprising a top rider surface opposite a bottom submerged surface, a front half opposite a rear half, a left half opposite a right half and a board centerline, wherein the board centerline extends from the front section half to the rear section half separating the left half from the right half; a left side riser disposed on the top rider surface located in the left half and rear half, the left side riser extending above the top rider surface and is configured to abut a rider's left rib cage and/or left hip; and a right side riser disposed on the top rider surface located in the right half and rear half, the right side riser extending above the top rider surface and is configured to abut a rider's right rib cage and/or right hip.

In other exemplary embodiments, the left side riser and right side riser may extend at least 1, 2, 3, 4, 5, 6 or more inches above the top rider surface.

The left side riser and right side riser may be translatable and lockable with respect to the buoyant board body towards and away from the board centerline thereby being adjustable to a width of the rider.

The left side riser and right side riser may be pivotably connected to the buoyant board body along a respective left and right axis generally parallel to the board centerline thereby the left and right side risers are configured to be foldable for storage and transport.

The left side riser and right side riser may be translatable and lockable with respect to the buoyant board body towards and away from the board centerline thereby being adjustable to a width of the rider, and also wherein the left side riser and right side riser may be pivotably connected to the buoyant board body along a respective left and right axis generally parallel to the board centerline thereby the left and right side risers are configured to be foldable for storage and transport.

The left side riser and right side riser may be removable from the buoyant board body.

A left cutout may be formed in the buoyant board body disposed ahead of the left side riser along the left half. A right cutout is formed in the buoyant board body disposed ahead of the right side riser along the right half. A minimum width between the left and right cutout may be 16, 15, 14, 13 or 12 inches or less.

In other words, the left cutout may be formed through a thickness of the buoyant board body between the top rider surface to the bottom submerged surface, the left cutout located ahead of the left side riser along the left half. Similarly, a right cutout may be formed through the thickness of the buoyant board body disposed ahead of the right side riser along the right half.

The front half may be pivotably connected to the rear half, the front half lockable to the rear half and releasable with a manual button.

A left pontoon may extend from the bottom submerged surface of the buoyant board body along the left half. A right pontoon may extend from the bottom submerged surface of the buoyant board body along the right half.

The top rider surface may comprise an angled surface along the rear half which narrows from a thicker portion near a center of the buoyant board body to a thinner portion at an end of the rear half, the angled surface configured to angle the rider's lower torso into the water.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1A:
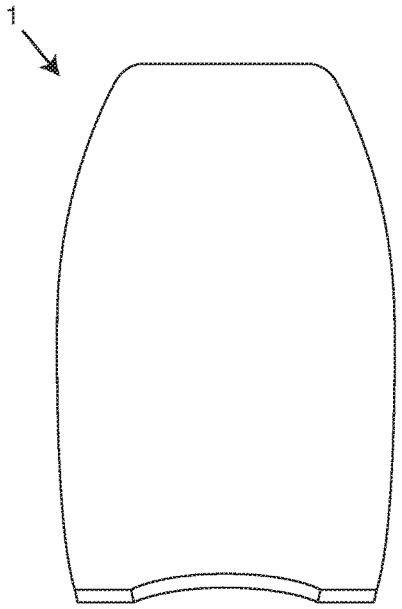
FIG. 1A PRIOR ART
FIG. 1A is a top view of a prior art body board.
Figure 1B:
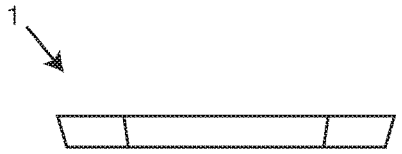
FIG. 1B PRIOR ART
FIG. 1B is a rear view of the structure of FIG. 1.
Figure 1C:
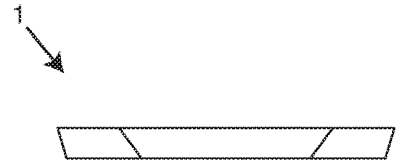
FIG. 1C PRIOR ART
FIG. 1C is a front view of the structure of FIG. 1.

FIGS. 1A, 1B and 1C show a prior art body board 1 which is very common and can be purchased throughout many retail stores. While various small design changes have been made over time, the basic layout has been the same for decades. The body board 1 is generally very flat and there has not been any novel or large improvements in the basic design for decades.

Figure 2B:
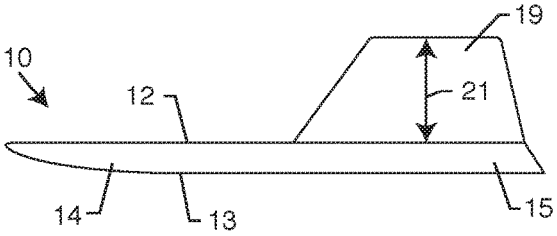
FIG. 2B is a side view of the structure of FIG. 2A.
Figure 2A:
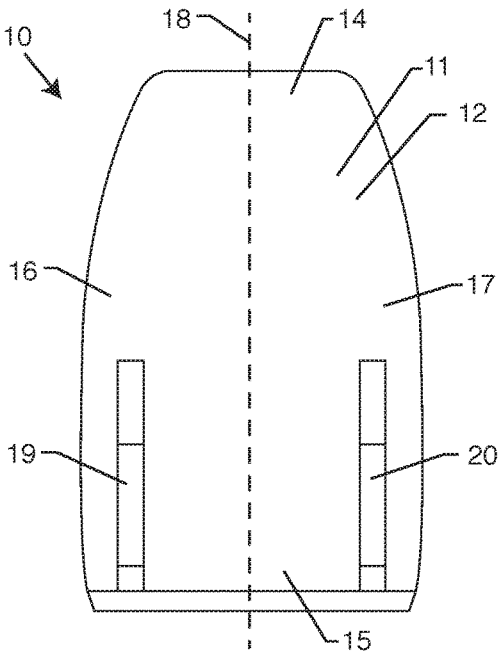
FIG. 2A is a top view of an exemplary body board having left and right risers.
Figure 2C:
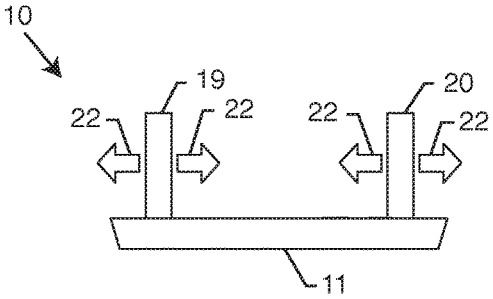
FIG. 2C is a rear view of the structure of FIG. 2A.

As shown in FIGS. 2A, 2B and 2C an exemplary embodiment of a body board 10 for use by a rider in water the rider laying upon the body board includes a buoyant board body 11 defined as comprising a top rider surface 12 opposite a bottom submerged surface 13, a front half 14 opposite a rear half 15, a left half 16 opposite a right half 17 and a board centerline 18. The board centerline 18 extends from the front half to the rear half separating the left half from the right half.

The buoyant board body 11 can be made out of any suitable material that can float, or does float once construction is completed. This means any foam, plastic, metal, fiberglass, composite or combination thereof can be used to make the board body 11.

A left side riser 19 is disposed on the top rider surface located in the left half and rear half. As best seen in FIG. 2B, the left side riser extends above the top rider surface and is configured to abut a rider's left rib cage and/or left hip. Similarly, a right side riser 20 is disposed on the top rider surface located in the right half and rear half. The right side riser extends above the top rider surface and is configured to abut a rider's right rib cage and/or right hip. The left side riser and right side riser may extend a distance 21 (height of risers) which is at least 1, 2, 3, 4, 5, 6 or more inches above the top rider surface. In this way, when the rider lays upon the board, the risers sandwich the rider's torso and keeps the rider in place relative to the board 10.

As shown in FIG. 2C the left side riser and right side riser may be translatable along direction 22 and lockable with respect to the buoyant board body. The translation 22 is towards and away from the board centerline 18 thereby being adjustable to a width of the rider.

Figure 3:
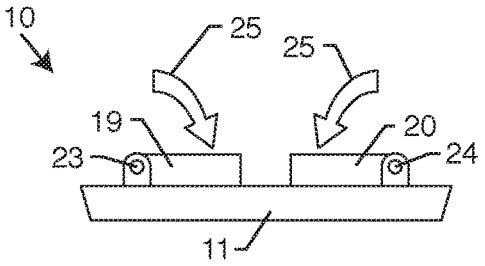
FIG. 3 PRIOR ART
FIG. 3 is a rear view similar to FIG. 2C now showing the translation of the risers.

As shown in FIG. 3, the left side riser and right side riser may be pivotably connected to the buoyant board body along a respective left axis 23 and right axis 24 generally parallel to the board centerline 18. Thereby, the left and right side risers are configured to be foldable (pivotable) in direction 25 for storage and transport such that they no longer stick upwards and take up too much space.

Figure 4:
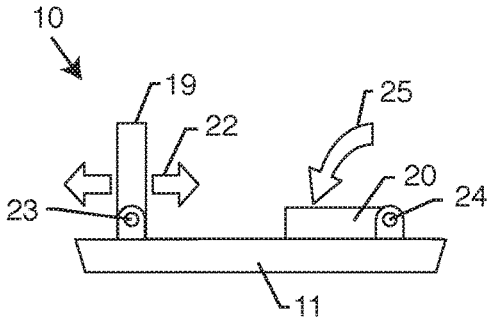
FIG. 4 is a rear view similar to FIG. 2C now showing the pivoting of the risers.

It is understood that the embodiment of FIG. 2C may be combined with the embodiment of FIG. 3. Accordingly, as shown in FIG. 4, the left side riser and right side riser may be translatable and lockable with respect to the buoyant board body towards and away from the board centerline thereby being adjustable to a width of the rider, and also wherein the left side riser and right side riser may be pivotably connected to the buoyant board body along a respective left and right axis generally parallel to the board centerline thereby the left and right side risers are configured to be foldable for storage and transport.

In another embodiment, the left side riser and right side riser may be removable from the buoyant board body. In this way, a rider could disconnect the risers to take up less space when storing or shipping.

Figure 5:
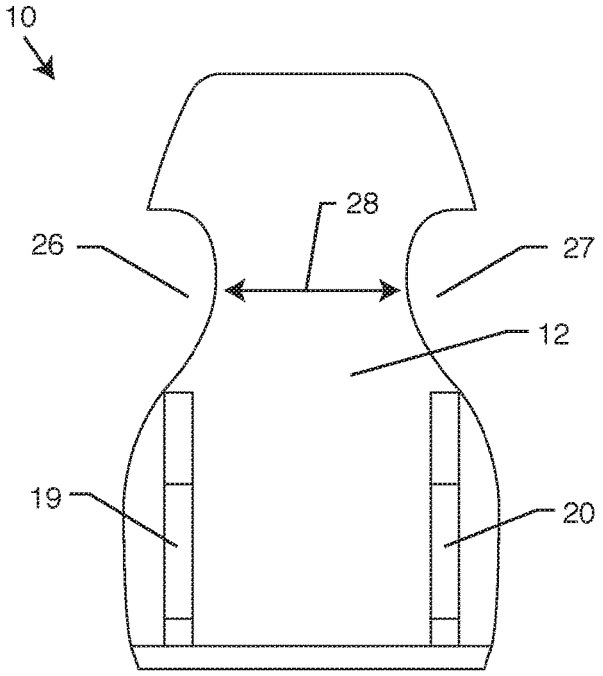
FIG. 5 is a top view another exemplary embodiment of a body board similar to FIG. 2A now showing left and right cutouts to allow access for a person's arm movement during a swimming action.

As best shown in the new embodiment of FIG. 5 left cutout 26 may be formed in the buoyant board body disposed ahead of the left side riser along the left half. A right cutout 27 is similarly formed in the buoyant board body disposed ahead of the right side riser along the right half. A minimum width 28 between the left and right cutout may be 16, 15, 14, 13 or 12 inches or less. In other words, the left cutout may be formed through a thickness of the buoyant board body between the top rider surface to the bottom submerged surface, the left cutout located ahead of the left side riser along the left half. Similarly, a right cutout may be formed through the thickness of the buoyant board body disposed ahead of the right side riser along the right half. The cutouts allow the rider to lay flat upon the board body and rotate their arms through a complete stroke. The removal of the material in the cutout area facilitates the ease of performing a swimming motion by the rider. The rider is then able to better propel himself/herself through the water as their hands are no longer needed to grip the board body and can easily penetrate down into the water during a swimming motion. This advantage is even greater for rider that wears webbed gloves.

Figure 6A:
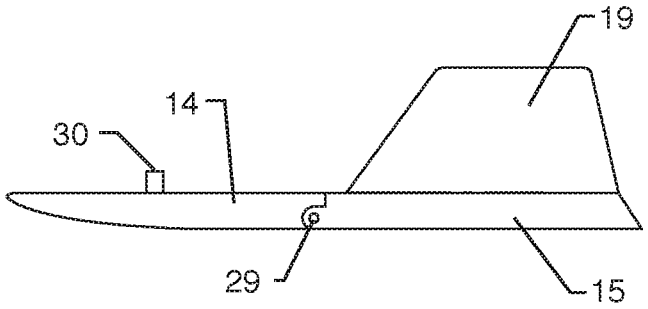
FIG. 6A is a side view of another exemplary embodiment of a body board now showing the front half pivotably connected to a rear half.
Figure 6B:
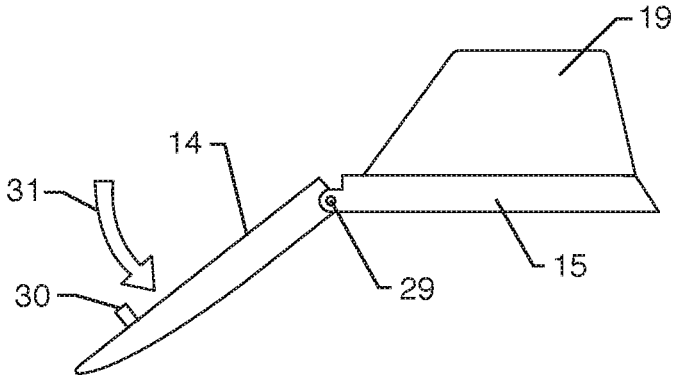
FIG. 6B is a side view of the structure of FIG. 6A now showing the front half pivoted down for a duck dive under an oncoming wave.

As best seen in FIGS. 6A and 6B, the front half 14 may be pivotably connected at pivot joint (pivot axis) 29 to the rear half 15. The front half 14 may be lockable to the rear half 15, where the halves may be releasable with a manual button 30. As best seen in FIG. 6B, the front half pivots along pivot direction 31. The reason for this is that sometimes it is hard to duck dive under an oncoming wave. Duck diving is the slang term used to describe the act of pushing the front of one's board under the bottom of an oncoming wave. By doing so, the rider can prevent an oncoming wave from unduly pushing the rider backwards. This technique is commonly done when a rider is first starting from the beach and attempting to get outwards into the water such that the rider can then attempt to catch a wave. The ability of the front of the board to pivot down aids in the duck diving technique.

FIGS. 7A-7F are of another embodiment of a body board 10 of the present invention. A left pontoon 32 may extend from the bottom submerged surface 13 of the buoyant board body along the left half. Similarly, a right pontoon 33 may extend from the bottom submerged surface of the buoyant board body along the right half. The pontoons help add buoyancy to the board 10 and aid in speeding up the rider's speed in the water.

Figure 7A:
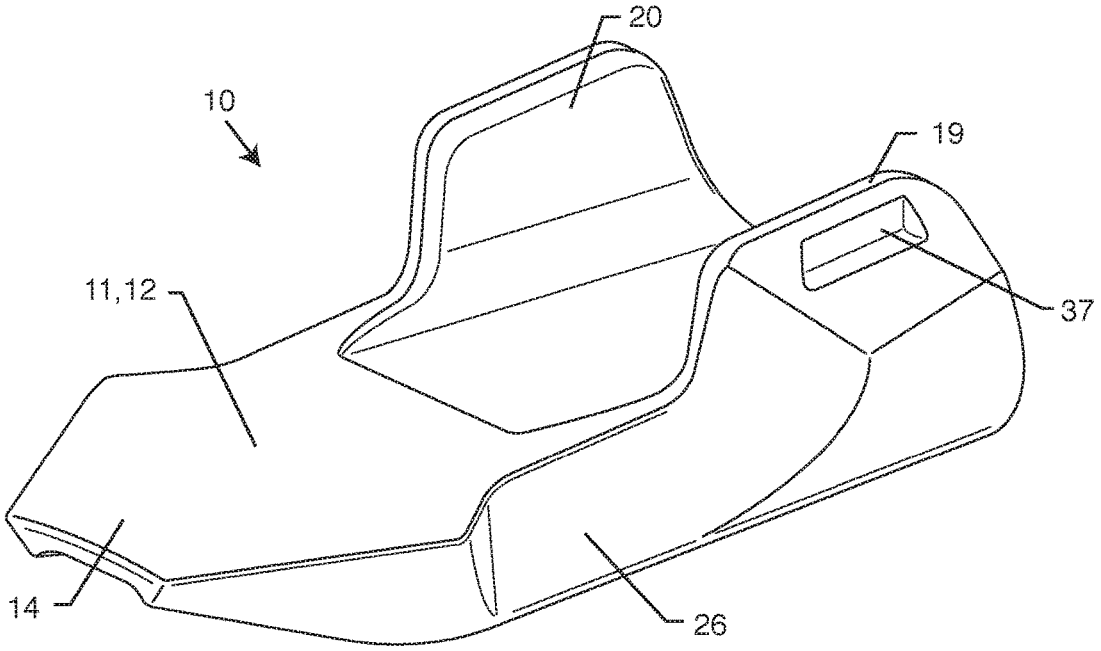
FIG. 7A is a top perspective view of exemplary embodiment of a body board of the present invention.
Figure 7B:
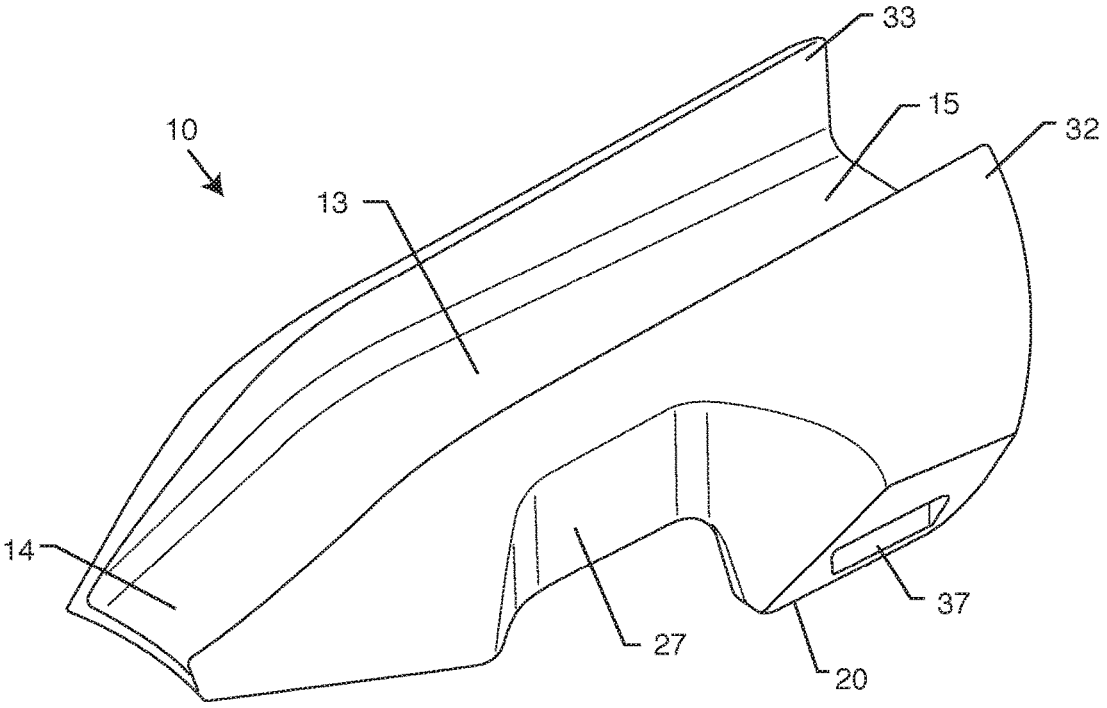
FIG. 7B is a bottom perspective view of the structure of FIG. 7A.
Figure 7C:
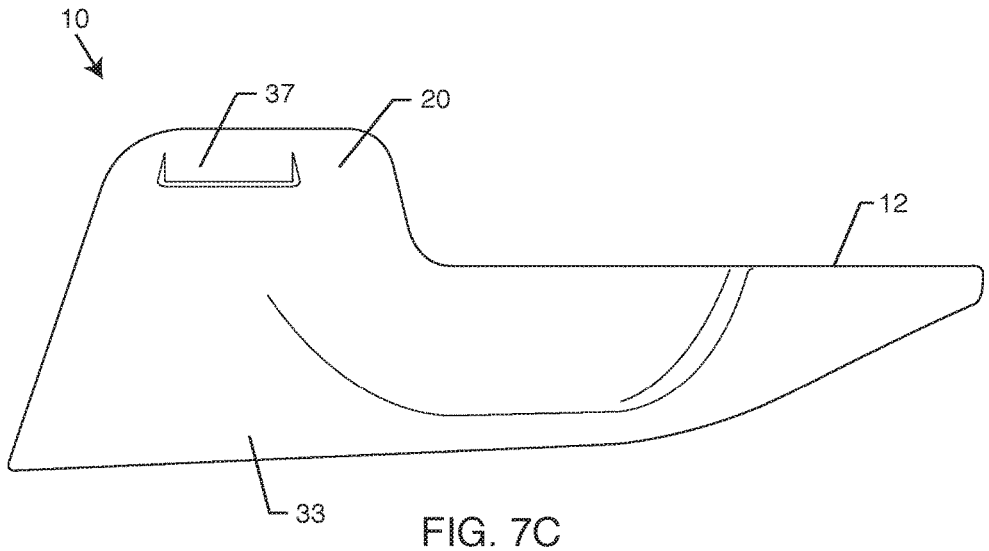
FIG. 7C is a side view of the structure of FIG. 7A.
Figure 7D:
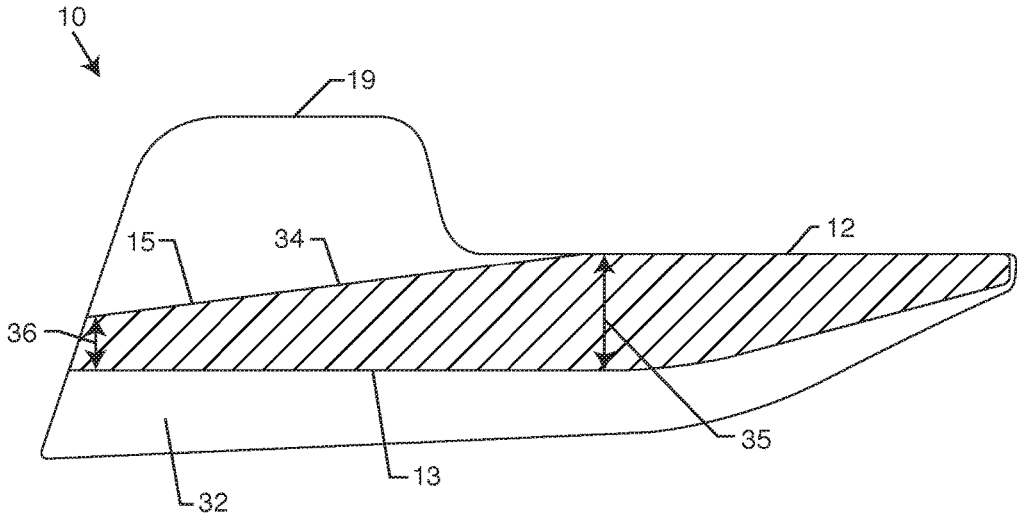
FIG. 7D is a sectional view similar to FIG. 7D taken through the centerline of the body board.
Figure 7E:
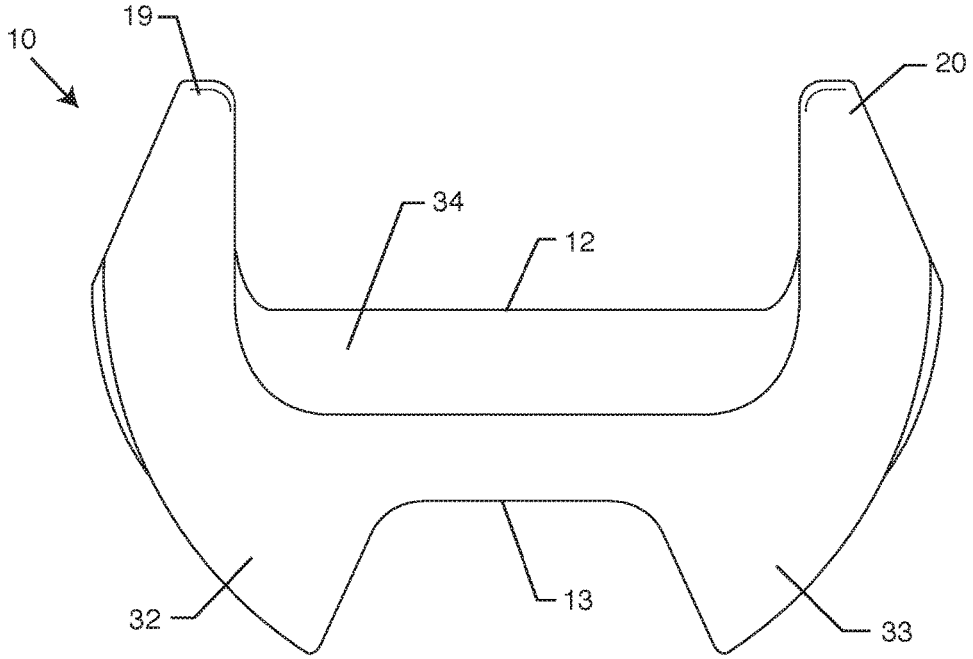
FIG. 7E is a rear view of the structure of FIG. 7A.
Figure 7F:
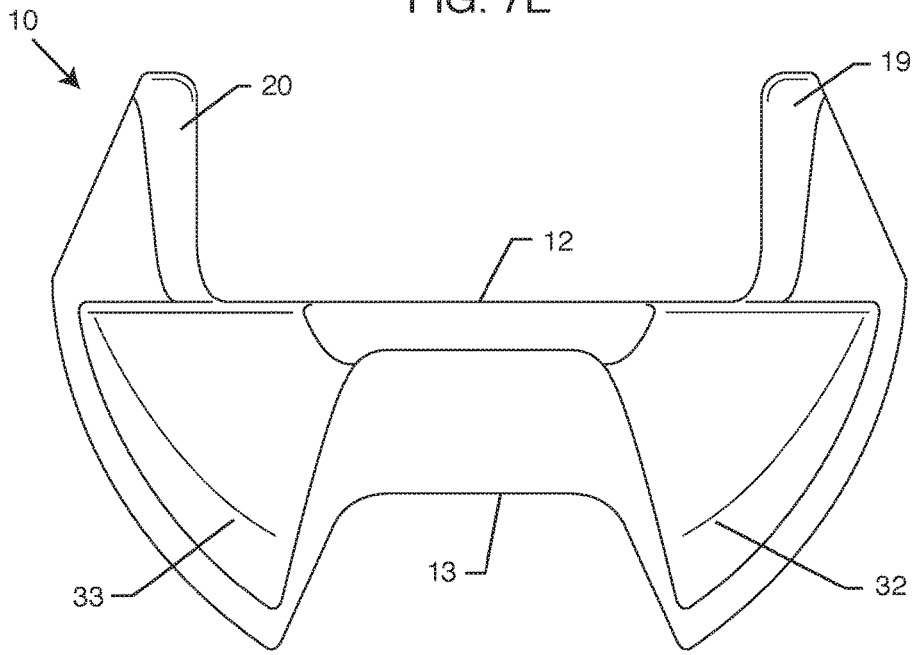
FIG. 7F is a front view of the structure of FIG. 7A.

FIG. 7D is a sectional view taken along the centerline 18 of the board and is similar to FIG. 7C. The top rider surface 12 may comprise an angled surface 34 along the rear half 15 which narrows from a thicker portion 35 near a center of the buoyant board body to a thinner portion 36 at an end of the rear half. The angled surface 34 is configured to angle the rider's lower torso into the water such that foot thrusts provide propulsion yet the rest of the rider's upper torso is kept above the water to reduce drag. This design may provide an substantially faster design such that a rider can propel one's self through the water at a substantially faster rate as compared to swimming with a prior art body board 1 or swimming in the water with no swimming aids.

Handles 37 may also be integrated into various portions of the body board 10 to facilitate ease of carrying while the board 10 is not in use.

Any of the embodiments taught throughout this specification can be mixed with or used in combination with the other embodiments taught herein. Furthermore, as one skilled in the art will recognize, the embodiments of the present invention free up the hands of the rider such that they may be used for forward propulsion and not holding onto one's body board. Although several embodiments have been described in detail for purposes of illustration, various modifications may be made to each without departing from the scope and spirit of the invention. Accordingly, the invention is not to be limited, except as by the appended claims.

NUMERALS

1 Body Board, Prior Art
10 Body Board
11 Buoyant Board Body
12 Top Rider Surface
13 Bottom Submerged Surface
14 Front Half
15 Rear Half
16 Left Half
17 Right Half
18 Centerline
19 Left Side Riser
20 Right Side Riser
21 Height of Risers
22 Translation Direction
23 Left Axis
24 Right Axis
25 Pivot Direction
26 Left Cutout
27 Right Cutout
28 Minimum Width, Between Cutouts
29 Pivot Joint
30 Manual Button, Release
31 Pivot Direction
32 Left Pontoon
33 Right Pontoon
34 Angled Surface
35 Thicker Portion
36 Thinner Portion
37 Handles

What is claimed is:

1. A body board for use by a rider in water where the rider lays upon the body board, the body board comprising:

a buoyant board body defined as comprising a top rider surface opposite a bottom submerged surface, a front half opposite a rear half, a left half opposite a right half and a board centerline, wherein the board centerline extends from the front half to the rear half separating the left half from the right half;

a left side riser disposed on the top rider surface located in the left half and rear half, the left side riser extending above the top rider surface and is configured to abut a rider's left rib cage and/or left hip; and a right side riser disposed on the top rider surface located in the right half and rear half, the right side riser extending above the top rider surface and is configured to abut a rider's right rib cage and/or right hip;

wherein the top rider surface comprises an angled surface along the rear half which narrows from a thicker portion near a center of the buoyant board body to a thinner portion at an end of the rear half, the angled surface configured to angle the rider's lower torso into the water.

2. The body board of claim 1, wherein the left side riser and right side riser extend at least 1 inch above the top rider surface.

3. The body board of claim 1, wherein the left side riser and right side riser extend at least 2 inches above the top rider surface.

4. The body board of claim 1, wherein the left side riser and right side riser extend at least 3 inches above the top rider surface.

5. The body board of claim 1, wherein the left side riser and right side riser extend at least 4 inches above the top rider surface.

6. The body board of claim 1, wherein the left side riser and right side riser are translatable and lockable with respect to the buoyant board body towards and away from the board centerline thereby being adjustable to a width of the rider.

7. The body board of claim 1, wherein the left side riser and right side riser are pivotably connected to the buoyant board body along a respective left and right axis generally parallel to the board centerline, wherein the left side and right side risers are lockable in either a deployed position or a stored position, wherein the left side and right side risers are configured to be foldable in the stored position for storage and transport.

8. The body board of claim 1, wherein the left side riser and right side riser are translatable and lockable with respect to the buoyant board body towards and away from the board centerline thereby being adjustable to a width of the rider, and also wherein the left side riser and right side riser are pivotably connected to the buoyant board body along a respective left and right axis generally parallel to the board centerline, wherein the left side and right side risers are lockable in either a deployed position or a stored position, wherein the left side and right side risers are configured to be foldable in the stored position for storage and transport.

9. The body board of claim 1, wherein the left side riser and right side riser are removably attachable to the buoyant board body.

10. The body board of claim 1, wherein a left cutout is formed in the buoyant board body disposed ahead of the left side riser along the left half.

11. The body board of claim 10, wherein a right cutout is formed in the buoyant board body disposed ahead of the right side riser along the right half.

12. The body board of claim 11, wherein a minimum width between the left and right cutout is 16 inches or less.

13. The body board of claim 11, wherein a minimum width between the left and right cutout is 15 inches or less.

14. The body board of claim 11, wherein a minimum width between the left and right cutout is 14 inches or less.

15. The body board of claim 1, wherein the front half is pivotably connected to the rear half, the front half lockable to the rear half and releasable with a manual button.

16. The body board of claim 1, including a left pontoon extending from the bottom submerged surface of the buoyant board body along the left half.

17. The body board of claim 16, including a right pontoon extending from the bottom submerged surface of the buoyant board body along the right half.

18. A body board for use by a rider in water the rider laying upon the body board face down, the body board comprising:

a buoyant board body defined as comprising a top rider surface opposite a bottom submerged surface, a front half opposite a rear half, a left half opposite a right half and a board centerline, wherein the board centerline extends from the front half to the rear half separating the left half from the right half;

a left side riser disposed on the top rider surface located in the left half and rear half, the left side riser extending above the top rider surface and is configured to abut a rider's left rib cage and/or left hip;

a right side riser disposed on the top rider surface located in the right half and rear half, the right side riser extending above the top rider surface and is configured to abut a rider's right rib cage and/or right hip;

a left cutout formed through a thickness of the buoyant board body between the top rider surface to the bottom submerged surface, the left cutout located ahead of the left side riser along the left half; and a right cutout formed through the thickness of the buoyant board body disposed ahead of the right side riser along the right half.

19. A body board for use by a rider in water where the rider lays upon the body board in a generally face down position, the body board comprising:

a buoyant board body defined as comprising a top rider surface opposite a bottom submerged surface, a front half opposite a rear half, a left half opposite a right half and a board centerline, wherein the board centerline extends from the front half to the rear half separating the left half from the right half;

a left side riser disposed on the top rider surface located in the left half and rear half, the left side riser extending above the top rider surface and is configured to abut a rider's left rib cage and/or left hip; and a right side riser disposed on the top rider surface located in the right half and rear half, the right side riser extending above the top rider surface and is configured to abut a rider's right rib cage and/or right hip;

wherein the left side riser and right side riser are translatable and lockable with respect to the buoyant board body towards and away from the board centerline thereby being adjustable to a width of the rider.

20. A body board for use by a rider in water where the rider lays upon the body board, the body board comprising:

a buoyant board body defined as comprising a top rider surface opposite a bottom submerged surface, a front half opposite a rear half, a left half opposite a right half and a board centerline, wherein the board centerline extends from the front half to the rear half separating the left half from the right half;

a left side riser disposed on the top rider surface located in the left half and rear half, the left side riser extending above the top rider surface and is configured to abut a rider's left rib cage and/or left hip; and a right side riser disposed on the top rider surface located in the right half and rear half, the right side riser extending above the top rider surface and is configured to abut a rider's right rib cage and/or right hip;

wherein the left side riser and right side riser are pivotably connected to the buoyant board body along a respective left and right axis generally parallel to the board centerline, wherein the left side and right side risers are lockable in either a deployed position or a stored position, wherein the left side and right side risers are configured to be foldable in the stored position for storage and transport.

21. A body board for use by a rider in water where the rider lays upon the body board, the body board comprising:

a buoyant board body defined as comprising a top rider surface opposite a bottom submerged surface, a front half opposite a rear half, a left half opposite a right half and a board centerline, wherein the board centerline extends from the front half to the rear half separating the left half from the right half;

a left side riser disposed on the top rider surface located in the left half and rear half, the left side riser extending above the top rider surface and is configured to abut a rider's left rib cage and/or left hip; and a right side riser disposed on the top rider surface located in the right half and rear half, the right side riser extending above the top rider surface and is configured to abut a rider's right rib cage and/or right hip;

wherein the left side riser and right side riser are translatable and lockable with respect to the buoyant board body towards and away from the board centerline thereby being adjustable to a width of the rider, and also wherein the left side riser and right side riser are pivotably connected to the buoyant board body along a respective left and right axis generally parallel to the board centerline, wherein the left side and right side risers are lockable in either a deployed position or a stored position, wherein the left side and right side risers are configured to be foldable in the stored position for storage and transport.

22. A body board for use by a rider in water where the rider lays upon the body board, the body board comprising:

a buoyant board body defined as comprising a top rider surface opposite a bottom submerged surface, a front half opposite a rear half, a left half opposite a right half and a board centerline, wherein the board centerline extends from the front half to the rear half separating the left half from the right half;

a left side riser disposed on the top rider surface located in the left half and rear half, the left side riser extending above the top rider surface and is configured to abut a rider's left rib cage and/or left hip; and a right side riser disposed on the top rider surface located in the right half and rear half, the right side riser extending above the top rider surface and is configured to abut a rider's right rib cage and/or right hip;

wherein the front half is pivotably connected to the rear half, the front half lockable to the rear half and releasable with a manual button.

23. A body board for use by a rider in water where the rider lays upon the body board, the body board comprising:

a buoyant board body defined as comprising a top rider surface opposite a bottom submerged surface, a front half opposite a rear half, a left half opposite a right half and a board centerline, wherein the board centerline extends from the front half to the rear half separating the left half from the right half;

a left side riser disposed on the top rider surface located in the left half and rear half, the left side riser extending above the top rider surface and is configured to abut a rider's left rib cage and/or left hip;

a right side riser disposed on the top rider surface located in the right half and rear half, the right side riser extending above the top rider surface and is configured to abut a rider's right rib cage and/or right hip;

a left pontoon extending from the bottom submerged surface of the buoyant board body along the left half; and a right pontoon extending from the bottom submerged surface of the buoyant board body along the right half.

* * * * *